United States Patent [19]

Young

[11] 4,126,281

[45] Nov. 21, 1978

[54] SKEINER

[76] Inventor: Bernard L. Young, 81 CSG Box 3061, Apo, N.Y. 09755

[21] Appl. No.: 885,853

[22] Filed: Mar. 13, 1978

[51] Int. Cl.[2] ..... B65H 54/60

[52] U.S. Cl. ..... 242/53; 242/1; 242/47; 242/96; 242/137.1; 242/158 R

[58] Field of Search ..... 242/53, 47, 48, 18 R, 242/1, 85; 86.8, 104, 137, 137.1, 138, 139, 140, 141, 146, 157.1, 158 R, 106, 84.43, 96, 100

[56] References Cited

U.S. PATENT DOCUMENTS

| | | | |
|---|---|---|---|
| 598,138 | 2/1898 | Cummins | 242/86.8 X |
| 679,850 | 8/1901 | Krueger | 242/84.43 |
| 1,483,729 | 2/1924 | Isted | 242/138 |
| 1,569,577 | 1/1926 | Robinson | 242/138 |
| 2,132,698 | 10/1938 | Price | 242/47 |
| 2,391,364 | 12/1945 | Threlkeld | 242/137.1 |
| 2,514,929 | 7/1950 | Brandt | 242/158 R |

FOREIGN PATENT DOCUMENTS

| | | | |
|---|---|---|---|
| 182,497 | 7/1955 | Austria | 242/158 R |

*Primary Examiner*—Stanley N. Gilreath
*Attorney, Agent, or Firm*—Howard I. Podell

[57] ABSTRACT

A box fitted with a hinged cover for winding a skein of yarn about a rod rotatably mounted in the box, with a handle externally fixed to the rod. A pair of spaced through slots are formed in the cover located parallel to each other and the rod, with a guide unit slidably mounted to a first slot and located to extend under the second slot inside the cover. The guide unit is formed of a loop of wire fixed to a knob that extends through the first slot so that a length of yarn can be fastened at one end to the rod through the second slot and the loop of the guide, with said thread being windable upon the rod when the handle is manually rotated and with the guide manually operated to guide the thread onto the rod along the length of the rod.

1 Claim, 1 Drawing Figure

FIG.1
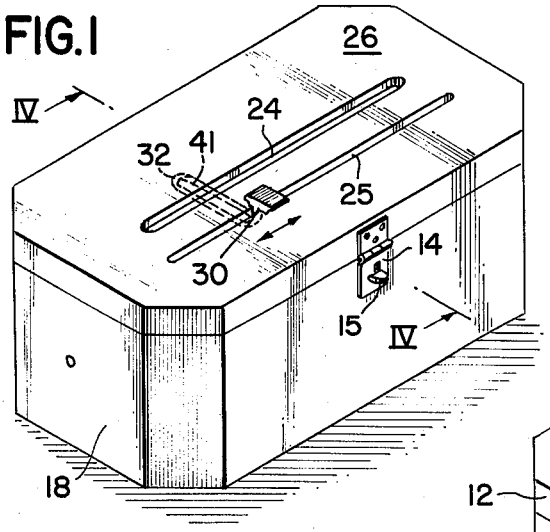
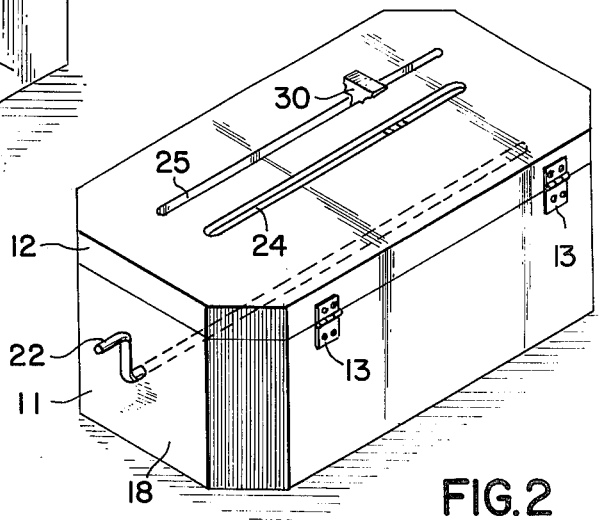
FIG.2
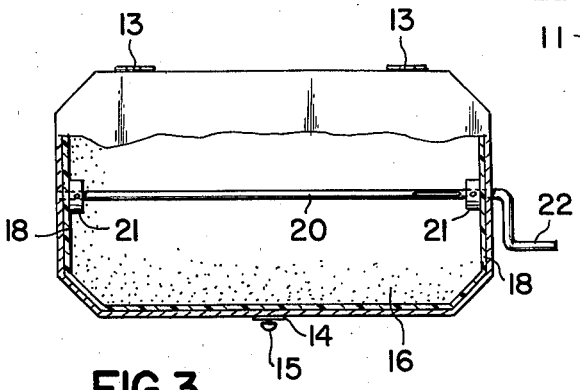
FIG.3
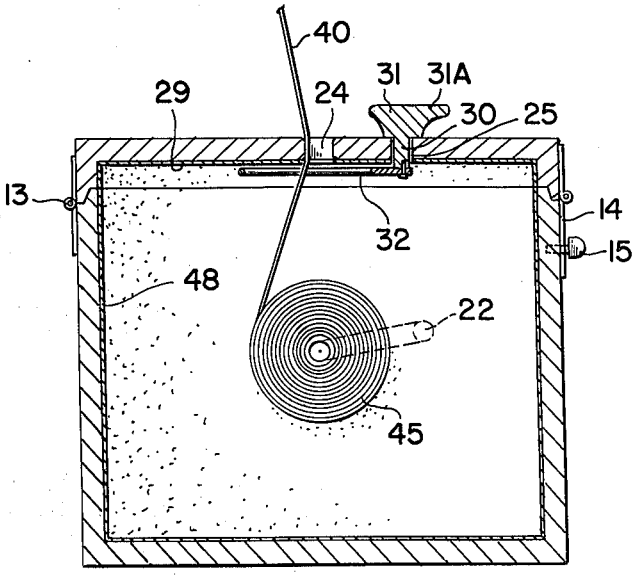
FIG.4

SKEINER

SUMMARY OF THE INVENTION

My invention is a box fitted with a hinged cover for winding a skein of yarn about a rod rotatably mounted in the box, with a handle externally fixed to the rod. A pair of spaced through slots are formed in the cover located parallel to each other and the rod, with a guide unit slidably mounted to a first slot and located to extend under the second slot inside the cover. The guide unit is formed of a loop of wire fixed to a knob that extends through the first slot so that a length of yarn can be fastened at one end to the rod through the second slot and the loop of the guide, with said yarn being windable upon the rod when the handle is manually rotated and with the guide manually operated to guide the yarn onto the rod along the length of the rod.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a front perspective view of the invention;

FIG. 2 is a rear perspective view of the invention;

FIG. 3 is a plan sectional view of the invention; and

FIG. 4 is an end sectional view of the invention, taken along line IV—IV of FIG. 1.

DESCRIPTION OF THE PREFERRED EMBODIMENT:

Turning now descriptively to the drawings, in which similar reference characters denote similar elements throughout the several views, FIGS. 1–4 illustrate the skeiner which is in the form of a container formed of an open box unit 11 and a cover unit 12 mounted by hinges 13 to the box unit. A latch 14 is fixed to the front face of the cover unit 12 for detachably engaging a fastener 15 fixed to the box unit 11.

A rod 20 is rotatably mounted in the interior 16 of the box unit to a pair of bearings 21 mounted to opposed end walls 18 of the box unit, with rod 20 extending through one wall 18 to join a crank handle section 22.

A pair of spaced through slots 24 and 25 are mounted in the top panel 26 of the cover unit 12, each extending parallel to rod 20.

A guide unit 30 formed of a knob section 31 joined to a closed loop 32 is slidably mounted in slot 25 with loop 32 extending freely under slot 24 on the underside 29 of the cover 12 along an axis normal to the axis of slot 25 from the underside of the cover to project externally of the cover panel 26.

The width of the external projection 31A of knob section 31 is greater than the width of slot 25 so that the guide unit 30 remains slidably engaged to the cover panel 26.

A length 40 of yarn to be wound in a skein is passed through slot 24 and the eye 41 of guide loop 32 onto rod 20 with the end of the yarn fixed to rod 20 by tape or other means. Handle 22 is rotated to rotate rod 20 and wind the yarn about the rod, with knob 31A being manually reciprocated along the length of slot 25 to guide the yarn being wound so that the diameter of the wound skein 45 is relatively uniform along its length and to provide as desired a skein that may be unrolled without effort.

After the yarn has been wound about rod 20, the yarn may be freely unwound for knitting or other purposes through slot 25 as desired.

The interior surface 48 of the container may be formed of a layer of cloth or other soft material, as desired.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A box for use in winding a length of yarn to form a skein and for use in dispensing said yarn from said skein, comprising, a box section fitted with a hinged cover, a rod rotatably mounted to opposed sides of said box section and fitted with a crank handle that extends beyond the exterior of a said side, a pair of spaced slots mounted in said cover, each oriented parallel to the said rod, with a guide unit slidably mounted in one of said slots, said guide unit fitted with a closed loop that extends along the underside of said cover across the other of said slots, with a knob slidably mounted in said one slot fixed to said loop, said knob extending above said cover.

* * * * *